United States Patent [19]

Zubrod

[11] Patent Number: 4,665,865

[45] Date of Patent: May 19, 1987

[54] STEAM GENERATOR HAVING MUTUALLY PARALLEL FLUE GAS FLUES

[75] Inventor: Horst-Dieter Zubrod, Erlangen, Fed. Rep. of Germany

[73] Assignee: Kraftwerk Union Aktiengesellschaft, Mülheim, Fed. Rep. of Germany

[21] Appl. No.: 886,970

[22] Filed: Jul. 17, 1986

[30] Foreign Application Priority Data

Jul. 18, 1985 [DE] Fed. Rep. of Germany ..... 3525676

[51] Int. Cl.[4] ..... F22B 25/00

[52] U.S. Cl. ..... 122/235 A; 122/4 D; 122/6 A; 122/235 K; 122/510; 122/511

[58] Field of Search ..... 110/233, 234, 245, 263, 110/216; 122/4 D, 6 R, 6 A, 235 R, 235 A, 235 C, 235 J, 235 K, 235 H, 332, 360, 365, 468, 471–474, 476–478, 481, 483, 493, 501, 510–511; 34/57 A; 432/15, 58; 431/7, 170; 165/104.16

[56] References Cited

U.S. PATENT DOCUMENTS

| | | | |
|---|---|---|---|
| 3,174,464 | 3/1965 | Johnson | 122/478 |
| 4,465,021 | 8/1984 | Richter et al. | 122/4 D |
| 4,524,727 | 6/1985 | Ammann | 122/235 A |
| 4,542,716 | 9/1985 | Dreuilhei et al. | 110/245 X |
| 4,594,967 | 6/1986 | Wolowodiuk | 110/245 X |

FOREIGN PATENT DOCUMENTS

| | | |
|---|---|---|
| 2345369 | 3/1975 | Fed. Rep. of Germany . |
| 2429993 | 1/1976 | Fed. Rep. of Germany . |
| 3210411 | 10/1982 | Fed. Rep. of Germany . |
| 2256954 | 8/1975 | France . |

*Primary Examiner*—Albert J. Makay
*Assistant Examiner*—Steven E. Warner
*Attorney, Agent, or Firm*—Herbert L. Lerner; Laurence A. Greenberg

[57] ABSTRACT

A steam generator includes first and second mutually parallel flue gas flues; the first flue gas flue having an upper end, an intermediate ceiling at the upper end having an upper surface, a cross flue leading from the first to the second flue gas flue, and first and second vertical walls formed of pipes and disposed opposite each other as seen along the cross flue; a steam generator frame supporting the intermediate ceiling; the intermediate ceiling being formed of pipes gas-tightly welded to each other and disposed alongside each other in one layer in tube tracks extended along the cross flue; each of the pipes of the intermediate ceiling changing into a respective pipe of one of the vertical walls; and first and second vertical suspension pipes connected from a common location along a given one of the tube tracks through the upper surface of the intermediate ceiling and through the cross flue to the steam generator frame for suspending the intermediate ceiling, the first suspension pipe changing into a pipe of the intermediate ceiling in the given tube track which changes into a pipe of the first vertical wall, and the second suspension pipe changing into a pipe of the intermediate ceiling in the given tube track which changes into a pipe of the second vertical wall.

5 Claims, 10 Drawing Figures

STEAM GENERATOR HAVING MUTUALLY PARALLEL FLUE GAS FLUES

The invention relates to a steam generator, especially a continuous flow steam generator, with first and second mutually-parallel flue gas flues, the first flue gas flue having an upper end with a cross flue leading to the second flue gas flue, the cross flue being formed by a gas-tight, tubed intermediate ceiling in the first flue gas flue, and two vertical pipe walls located opposite each other along the direction of the cross flue.

Such a steam generator may have a fluidization furnace and may be equipped with a cyclone separator for ash removal. The first flue gas flue leads to the crude gas inlet of the cyclone separator, which has a clean or purified gas outlet leading to the second flue gas flue through the cross flue.

The intermediate ceiling in the first flue gas flue overhangs and is made of fire-proof clay. The tube system is embedded therein.

Such an intermediate ceiling is only suited for relatively small steam generators because the sum of the weights of intermediate ceiling and fly ash deposits on top of the intermediate ceiling can become too great in larger steam generators.

It is accordingly an object of the invention to provide a steam generator which overcomes the hereinaforementioned disadvantages of the heretofore-know devices of this general type and to provide an intermediate ceiling which can accept any weight, even in larger steam generators.

With the foregoing and other objects in view, there is provided, in accordance with the invention, a steam generator, comprising first and second mutually parallel flue gas flues; the first flue gas flue having an upper end, an intermediate ceiling at the upper end having an upper surface, a cross flue leading from the first to the second flue gas flue, and first and second vertical walls formed of pipes and disposed opposite each other as seen along the cross flue a steam generator frame supporting the intermediate ceiling; the intermediate ceiling being formed of pipes gas-tightly welded to each other and disposed alongside each other in one layer in tube tracks extended along the cross flue; each of the pipes of the intermediate ceiling changing into a respective pipe of one of the vertical walls; and first and second vertical suspension pipes connected from a common location along a given one of the tube tracks through the upper surface of the intermediate ceiling and through the cross flue to the steam generator frame for suspending the intermediate ceiling, the first suspension pipe changing into a pipe of the intermediate ceiling in the given tube track which changes into a pipe of the first vertical wall, and the second suspension pipe changing into a pipe of the intermediate ceiling in the given tube track which changes into a pipe of the second vertical wall.

This not only makes it possible to provide an intermediate ceiling suspension adaptable to the static requirements and to the requirements of a compact steam generator structure, but the intermediate ceiling can also represent an additional heating surface which is cooled uniformly by the steam flowing through its tubes due to the fact that the tubes are evenly distributed over the entire ceiling surface. Furthermore, the intermediate ceiling does not wear to a great degree because erosion caused by flying ash is avoided to the greatest possible extent. This applies particularly to the lower surface of the intermediate ceiling because there are no tube bends at that location jutting out of the intermediate ceiling and because the flue gas can flow parallel to the tube tracks.

In accordance with another feather of the invention, there is provided an intermediate ceiling header outside the second vertical wall being connected to at least one of the pipes of the intermediate ceiling.

In accordance with a further feature of the invention, the pipes of the second vertical wall are disposed vertically alongside each other in one layer on the outside of the vertical walls in front of the intermediate ceiling in a plane perpendicular to the second vertical wall. In accordance with an additional feature of the invention, the plane perpendicular to said second vertical wall is disposed at said given tube track.

In accordance with a concomitant feature of the invention, the first flue gas flue has side walls and the plane perpendicular to said second vertical wall is disposed at one of the side walls of the first flue gas flue.

Other features which are considered as characteristic for the invention are set forth in the appended claims.

Although the invention is illustrated and described herein as embodied in a steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
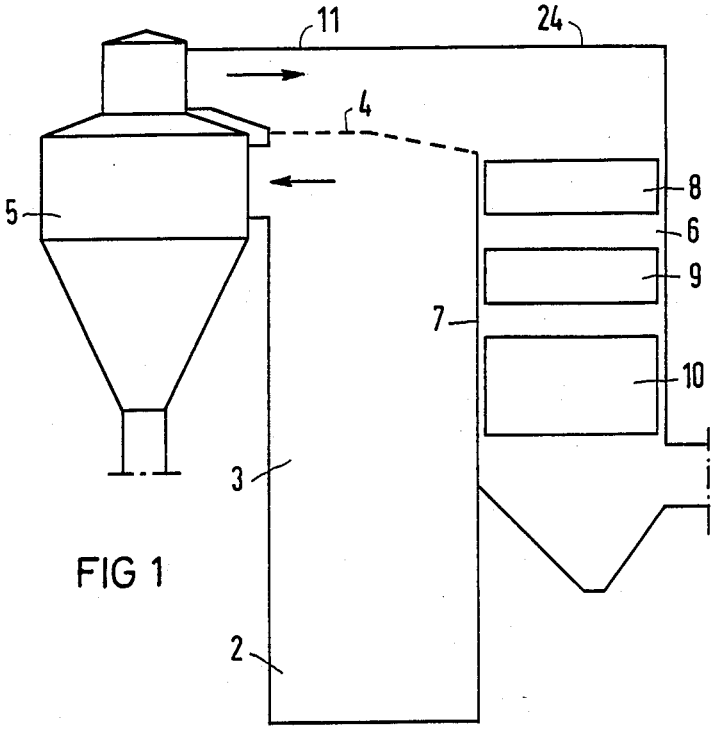
FIG. 1 is a highly diagrammatic, longitudinal-sectional view of a continuous flow steam generator according to the invention.

Referring now to the figures of the drawings in detail and first, particularly, to FIG. 1 thereof, there is seen a continuous flow steam generator including a combustion chamber or firebox 2 with a first flue gas flue 3 having an upper end which is closed by an intermediate ceiling 4. A crude gas inlet of a cyclone separator 5 is connected below the intermediate ceiling 4, along side the flue gas flue 3.

The continuous flow steam generator according to FIG. 1 also has a second flue gas flue 6. A rear wall 7 of the first flue gas flue 3 forms a gas-tight tube wall in common with the second flue gas flue 6. Reheating surfaces 8 and 9 as well as a feed water preheater surface 10 are disposed in the second flue gas flue 6. The intermediate ceiling 4 forms a cross flue 11 at the upper end of the first flue gas flue 3, below a ceiling wall 24 of the two flue gas flues 3 and 6. The cross flue 11 is conducted to the upper end of the second flue gas flue 6 and is connected to a clean or pure gas outlet of the cyclone separator 5.

Figure 2:
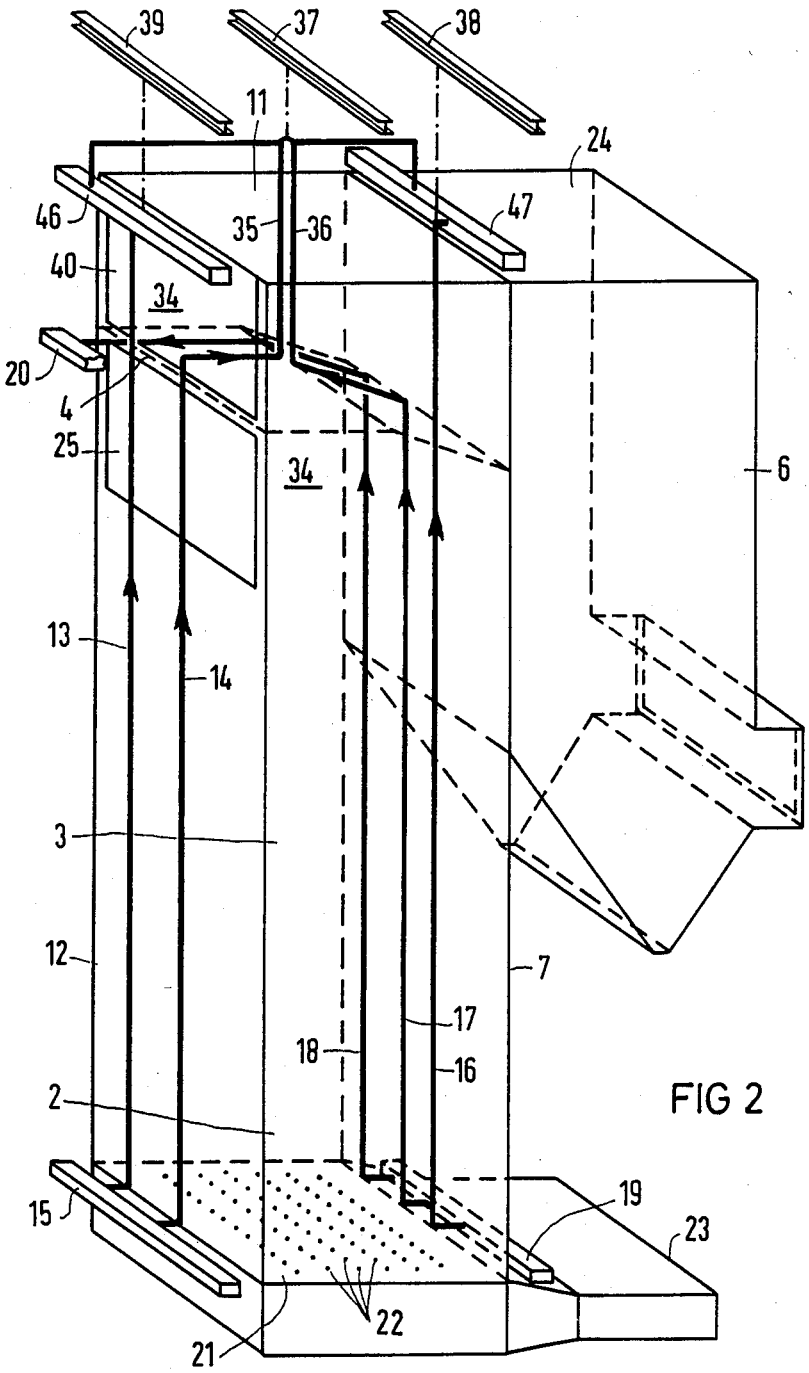
FIG. 2 is a perspective view of two parallel flue gas flues of the continuous flow steam generator according to FIG. 1.
Figure 3:
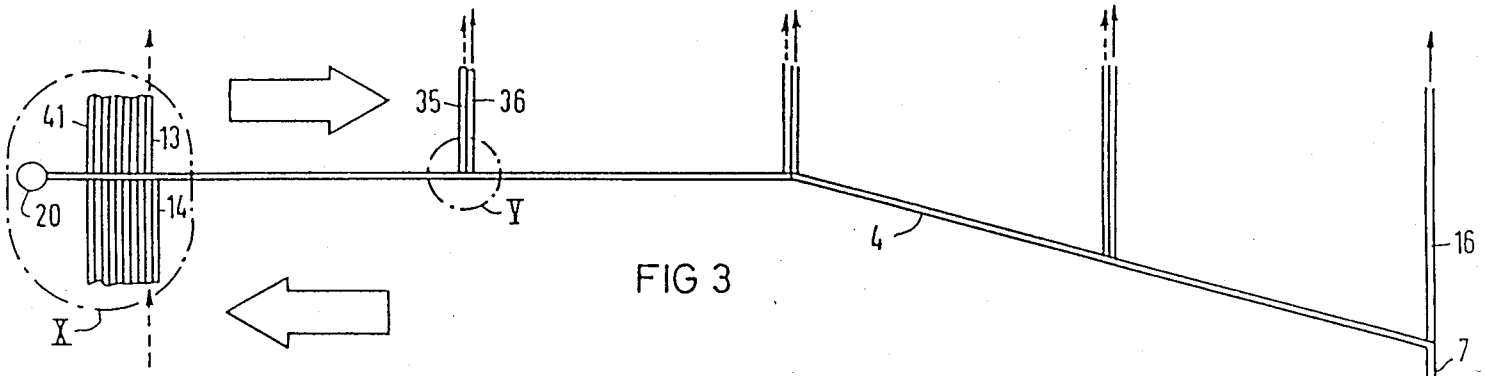
FIG. 3 is a fragmentary, longitudinal-sectional view of an intermediate ceiling in one flue gas flue of the continuous flow steam generator according to FIGS. 1 and 2.
Figure 4:
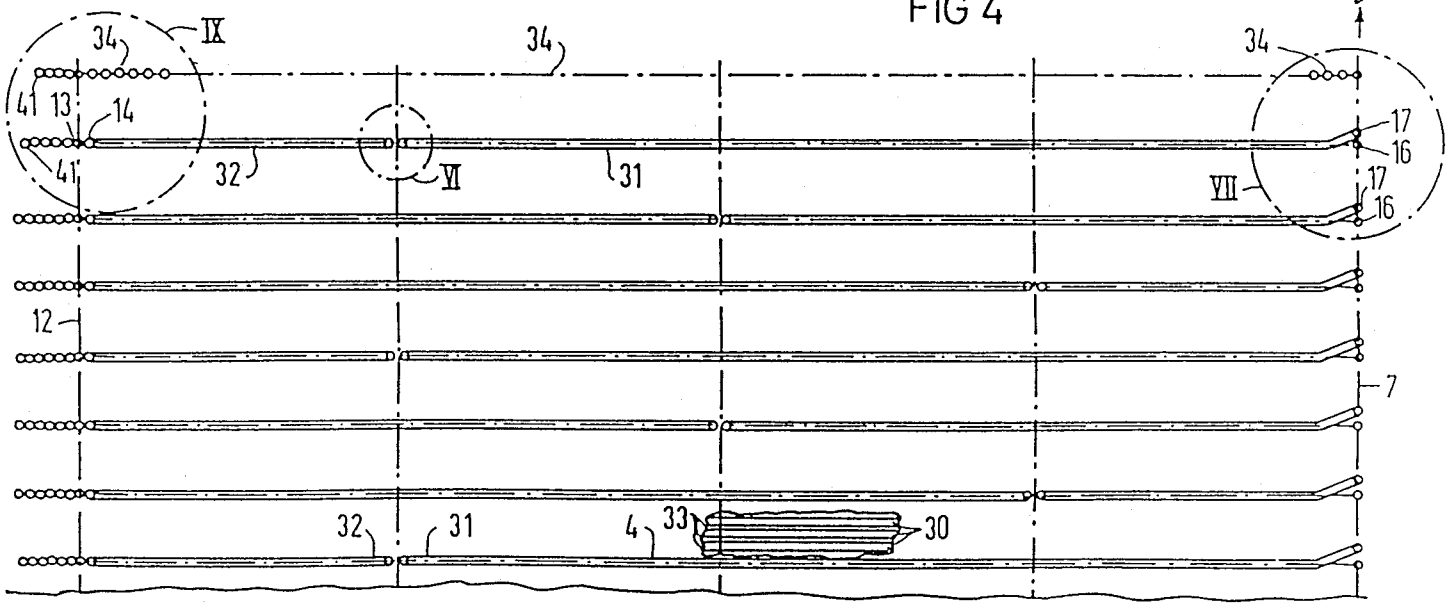
FIG. 4 is a fragmentary top-plan view of the intermediate ceiling according to FIG. 3.
Figure 8:
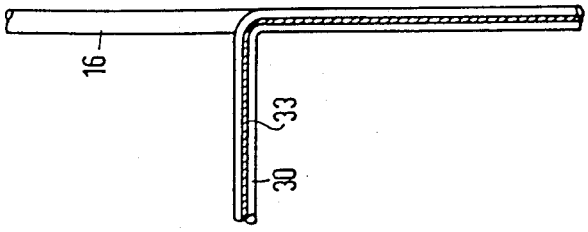
FIG. 8 is a cross-sectional view taken along the line VIII—VIII in FIG. 7, in the direction of the arrows.
Figure 7:
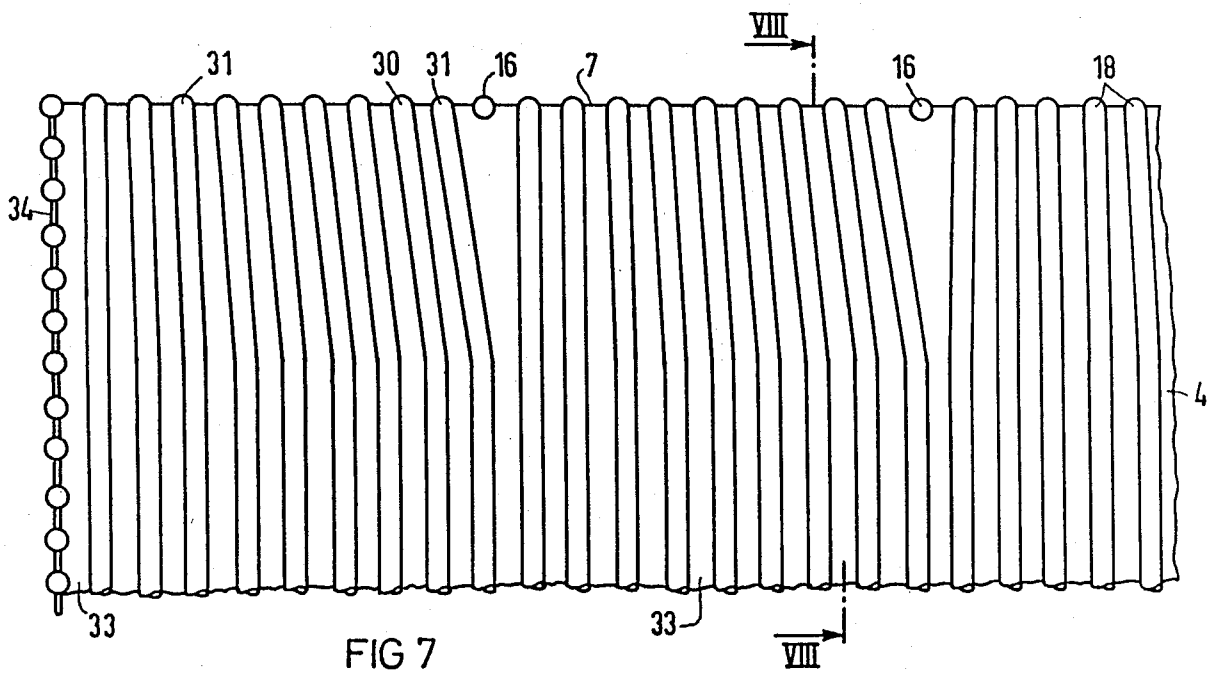
FIG. 7 is an enlarged view of an area VII in FIG. 4.
Figure 10:
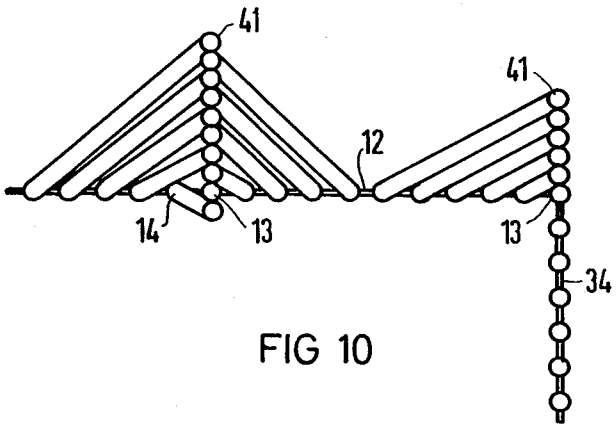
FIG. 10 is an enlarged view of an area X in FIG. 3.
Figure 9:
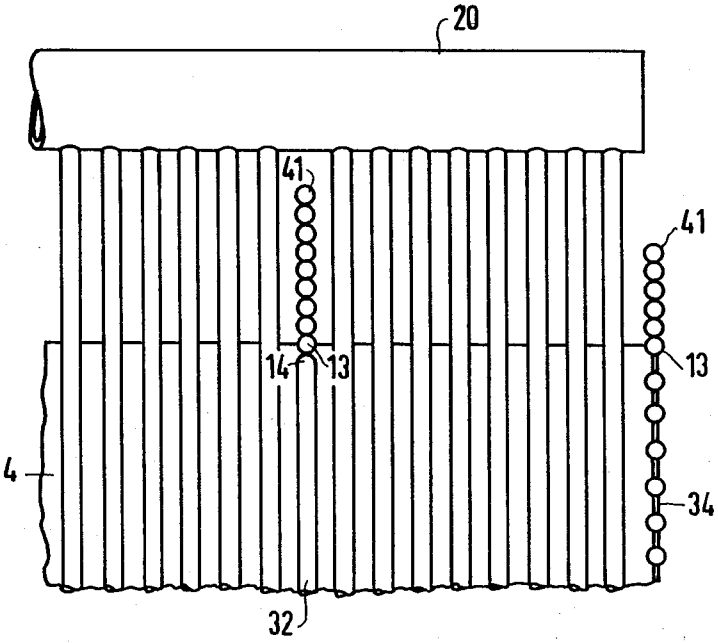
FIG. 9 is an enlarged view of an area IX in FIG. 4.

As FIG. 2 shows more clearly, the first flue gas flue 3 has two vertical tube walls 7 and 12 which are parallel to each other and opposite each other as seen in the direction of the cross flue 11. Both tube walls, i.e. the front wall 12 and the rear wall 7 of the first flue gas flue 3 are provided with gas-tight and vertical tubes. The walls are formed by vertical riser pipes, each of which is gas-tightly welded on two longitudinal sides to another riser pipe. A web or connecting piece is disposed between each two riser pipes.

Flowwise, the vertical pipes, in particular riser pipes 13 and 14, are connected at lower ends thereof to an inlet header 15 and at upper ends thereof to an outlet header 46.

Vertical riser pipes 16 to 18 of the rear wall 7 of the first flue gas flue 3 are also connected flowwise at lower ends thereof to an inlet header 19. Only the riser pipes 16 and 17 of the riser pipes 16–18 of the rear wall 7 are connected flowwise at the upper ends thereof to an outlet header 47. The remaining riser pipes 18 are transformed at the upper ends thereof into tubes of the intermediate ceiling 4. The intermediate ceiling tubes are, in turn, connected flowwise to an intermediate ceiling header 20, on the outside of the front wall 12.

The first flue gas flue 3 has non-illustrated sidewalls on both sides of the space between the front wall 12 and the rear wall 7 which are also provided with gas-tight and vertical tubes.

In order to achieve fluidization, a combustion chamber or fire box floor 21 for the combustion chamber 2 is provided at the lower end of the first flue gas flue 3. The combustion chamber floor 21 contains a series of air inlet nozzles 22. An air inlet line 23 discharges below the floor 21 for feeding air for the inlet nozzles 22 into the combustion chamber 2 with overpressure.

An ash discharge which is also provided at the combustion chamber floor 21 and an inlet hole in a sidewall of the flue gas flue 3, e.g. for coal granules and for conveying air for the coal granules and into the combustion chamber 2, are not shown in the drawing.

Besides the gas-tight tube wall 7 which is common to the second flue gas flue 6 and the first flue gas flue 3, the other non-illustrated walls of the second flue gas flue 6 are also gas-tight walls. Both flue gas flues 3 and 6 are closed at the upper ends thereof by the common ceiling wall 24 which has gas-tight tubes that are also not shown.

The intermediate ceiling 4 in the first flue gas flue 3 is angled or bent-off at a horizontal edge which is parallel to the front wall 12 and the rear wall 7 of the first flue gas flue 3 in the shape of a roof, so that the terminal edge of the intermediate ceiling 4 at the rear wall 7 is lower than the terminal edge at the front wall 12. This causes the flue gas from the first flue gas flue 3 to be conducted to an outlet opening 25 located below the intermediate ceiling 4 in the front wall 12 of the first flue gas flue 3. The crude gas inlet of the cyclone separator 5 which is not shown in FIG. 2, is connected to the outlet opening 25.

As FIGS. 3, 4, and 7 to 10 show in greater detail, the intermediate ceiling 4 is composed of tubes 30, 31, 32 welded to each other in a gas-tight manner. The tubes 30 to 32 run along the direction of the cross flue 11 and are disposed side by side in one layer in tube tracks. Each one of the tubes 30 to 32 is welded gas-tightly at two longitudinal sides to another tube 30 to 32. A respective web 33 is disposed between each two tubes. Such a web 33 also gas-tightly welds the intermediate ceiling to the two sidewalls of the first flue gas flue 3 which contains vertical riser pipes.

The rear wall 7 with its mutually spaced-apart riser pipes 16 which are connected to the outlet header 47 and run between the cross flue 11 and the second flue gas flue 6, is suspended from a beam 38 of a non-illustrated steam generator frame by supporting rods.

The riser pipes 18 of the rear wall 7 become the pipes 30 of the intermediate ceiling 4 which run in the direction of the cross flue 11 and are connected to the intermediate ceiling header 20 at the outside of the front wall 12 of the first flue gas flue 3.

The riser pipes 17 of the rear wall 7 of the first flue gas flue 3 are mutually spaced-apart and become the pipes 31 of the intermediate ceiling 4 which extend in the longitudinal direction of the cross flue 11.

Figure 5:
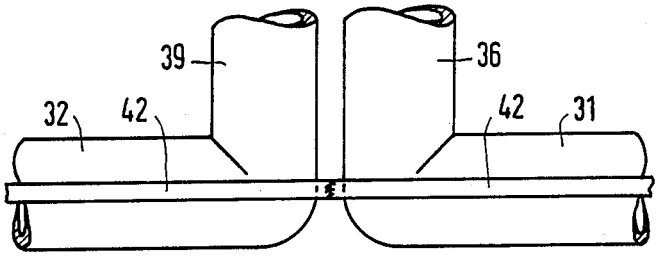
FIG. 5 is an enlarged view of an area V in FIG. 3.
Figure 6:
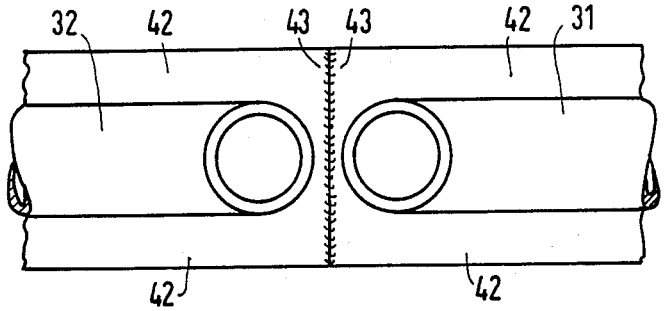
FIG. 6 is an enlarged view of an area VI in FIG. 4.

At the areas V and VI of the intermediate ceiling 4, which are shown in detail in FIGS. 5 and 6, the pipes 31 each become a first vertical suspension pipe 36 which protrudes from the top of the intermediate ceiling 4 and intersects the cross flue 11. Each of these suspension pipes 36 supports the intermediate ceiling 4 through supporting rods from one beam 37 of the non-illustrated steam generator frame.

On the outside of the ceiling wall 24 the suspension pipe 36 becomes a cross pipe which is ultimately connected to the outlet header 47. The riser pipes 16 which are also connected to the outlet header 47 suspend the rear wall 7 of the first flue gas flue 3 from the beam 38 of the non-illustrated steam generator frame.

The riser pipes 14 of the front wall 12 of the first flue gas flue 3 become the pipes 32 of the intermediate ceiling 4 which run along the direction of the cross flue 11 and are each located in the same tube track as the pipes 31 of the intermediate ceiling 4. A pipe 32 becomes a second suspension pipe 35 which likewise protrudes from the top of the intermediate ceiling 4, at the same location along the tube track where the first suspension pipe 36 protrudes from the top of the intermediate ceiling 4. The suspension pipe 35 together with the suspension pipe 36, runs vertically through the cross flue 11 and the ceiling wall 24. The intermediate wall 4 also hangs on the beams 37 of the steam generator frame by means of the suspension pipes 35 through supporting rods, exactly as with the suspension pipes 36. At the point of suspension thereof, each suspension pipe 35 also becomes a cross pipe which ultimately is connected through a downpipe to the outlet header 46 which is also connected the riser pipes 13 of the front wall 12 of the first flue gas flue 3.

The front wall 12 of the first flue gas flue 3 with its riser pipes 13 is suspended through supporting rods from a beam 39 of the non-illustrated steam generator frame. The riser pipes of the front wall 12 other than the riser pipes 13, i.e. the riser pipes 14 and the remainder of the riser pipes, are disposed along side each other in one layer and are guided vertically on the outside of the front wall 12 in front of the intermediate ceiling 4, in planes or levels 41 perpendicular to the front wall 12, i.e. in front of the inlet opening 25 of the first flue gas flue 3 and an inlet opening 40 in the front wall 12 for the cross flue 11 to which the clean or purified gas outlet of the cyclone separator is connected. The planes 41 are located at the tube tracks of the intermediate ceiling 4 with the suspension pipes 35 and 36 protruding from the intermediate ceiling 4 and at sidewalls 34 of the first flue gas flue 3. Each plane 41 also contains one of the riser pipes 13, by means of which the front wall 12 is suspended from the beam 39. The riser pipes 14 are each directly adjacent a riser pipe 13. Each riser pipe 14 becomes a tube 32 of the intermediate ceiling 4 in the planes 41 on the inside of the front wall 12 of the first flue gas flue 3 . As FIGS. 5 and 6 show, two connecting parts, each containing two pipe nipples, are provided at the locations of the intermediate ceiling 4 where the suspension pipes 36 and 35 of the same tube track protrude out of the intermediate ceiling. One connecting part is connected to a pipe 31 of the intermediate ceiling 4 and to the associated suspension pipe 36; the other connecting part is connected to a pipe 32 of the intermediate ceiling 4 and to the associated suspension pipe 35. The pipe nipples of the two connecting parts to which the pipes 31 and 32 are connected, have lateral webs or connecting pieces 42 which become a cross web or connecting piece 43 to the other pipe nipple at the end. The cross webs 43 of both connecting parts are welded to each other gas-tightly, while the lateral webs 42 are welded gas-tightly at the ends to the lateral webs on the pipes 31 and 32 and are gas-tightly welded laterally to adjacent lateral webs of pipes 30 on both sides.

The foregoing is a description corresponding in substance to German Application P 35 25 676.1, dated July 18, 1985, the International priority of which is being claimed for the instant application, and which is hereby made part of this application. Any material discrepancies between the foregoing specification and the aforementioned corresponding German application are to be resolved in favor of the latter.

I claim:

1. Steam generator, comprising first and second mutually parallel flue gas flues; said first flue gas flue having an upper end, an intermediate ceiling at said upper end having an upper surface, a cross flue leading from said first to said second flue gas flue, and first and second vertical walls formed of pipes and disposed opposite each other as seen along said cross flue; a steam generator frame supporting said intermediate ceiling; said intermediate ceiling being formed of pipes gas-tightly welded to each other and disposed alongside each other in one layer in tube tracks extended along said cross flue; each of said pipes of said intermediate ceiling changing into a respective pipe of one of said vertical walls; and first and second vertical suspension pipes connected from a common location along a given one of said tube tracks through said upper surface of said intermediate ceiling and through said cross flue to said steam generator frame for suspending said intermediate ceiling, said first suspension pipe changing into a pipe of said intermediate ceiling in said given tube track which changes into a pipe of said first vertical wall, and said second suspension pipe changing into a pipe of said intermediate ceiling in said given tube track which changes into a pipe of said second vertical wall.

2. Steam generator according to claim 1, including an intermediate ceiling header outside said second vertical wall being connected to at least one of said pipes of said intermediate ceiling.

3. Steam generator according to claim 1, wherein said pipes of said second vertical wall are disposed vertically alongside each other in one layer on the outside of said vertical walls in front of said intermediate ceiling in a plane perpendicular to said second vertical wall.

4. Steam generator according to claim 3, wherein said plane perpendicular to said second vertical wall is disposed at said given tube track.

5. Steam generator according to claim 3, wherein said first flue gas flue has side walls and said plane perpendicular to said second vertical wall is disposed at one of said side walls of said first flue gas flue.

* * * * *